United States Patent [19]

Jarosz et al.

[11] 4,419,658

[45] Dec. 6, 1983

[54] PORTABLE COMBINATION LAMP, SMOKE DETECTOR AND POWER FAILURE ALARM

[75] Inventors: Anthony M. Jarosz, Dracut, Mass.; Randy R. Stevens, Delray Beach, Fla.

[73] Assignee: T. J. Company, Ayer, Mass.

[21] Appl. No.: 249,929

[22] Filed: Apr. 1, 1981

[51] Int. Cl.[3] ..... G08B 19/00; G08B 23/00

[52] U.S. Cl. ..... 340/521; 340/586; 340/628; 340/636; 340/693; 340/321

[58] Field of Search ..... 340/521, 577, 578, 579, 340/584, 586, 588-590, 628, 629, 635, 636, 546, 511, 510, 321, 693

[56] References Cited

U.S. PATENT DOCUMENTS

| | | | |
|---|---|---|---|
| 2,982,949 | 5/1961 | Pivetz | 340/586 |
| 3,430,219 | 2/1969 | Powers | 340/586 |
| 3,911,425 | 10/1975 | Muncheryan | 340/586 |
| 4,266,218 | 5/1981 | Kardash | 340/629 |

*Primary Examiner*—Donnie L. Crosland

*Attorney, Agent, or Firm*—Morse, Altman & Dacey

[57] ABSTRACT

A portable protection device is shown for use in sounding a warning in the event of smoke or power failure and to supply a portable high intensity lamp when needed. The unit is enclosed in a small, light weight portable housing and includes a smoke alarm, a high intensity lamp and a power failure alarm all operable from an AC line source or from a self contained DC battery source. The device is useful for travelers at hotels, students at dormitories, and the like.

4 Claims, 3 Drawing Figures

PORTABLE COMBINATION LAMP, SMOKE DETECTOR AND POWER FAILURE ALARM

BACKGROUND OF THE INVENTION

1. Field of the Invention

This invention relates generally to smoke and power failure detectors and more particularly is directed towards a novel portable combination lamp, smoke detector and power failure detector operable on both battery and AC supply.

2. Description of the Prior Art

Conventional smoke detectors are available for both AC and DC operation. The typical AC smoke detector may be a smoke detecting system in which several smoke detectors are distributed about a building and are all connected by a network of leads to a common power supply and panel. AC detectors are also available as single plug-in units. More popular are the battery-operated individual smoke detectors which may be readily located throughout a building by merely attaching the same to a wall or ceiling. Some smoke detectors are combined with a burglar alarm device and may also be coupled to stand-by lighting units. While such warning devices are efficient for use in a fixed location such as a home or office, they are not particularly portable because of their size and weight and lack functions that would be useful to travelers.

At present there is no portable warning device available to travelers which is of a size and configuration appropriate for easy transportation and which is not only adapted to warn the traveler of the presence of smoke, but also to warn him of a power failure in the building. Loss of electrical power is a common condition that occurs at the start of a fire and which may even precede the detection of smoke at a remote location from the fire. Also, there is no device available which also combines with such a detector a high intensity lamp which the occupant of a hotel room, for example, might use to escape at night through passage ways that may be dark because of a power failure.

Accordingly, it is an object of the present invention to provide a portable personal warning device adapted to detect smoke and/or a power failure in a building and provide ample light for use in an emergency. Another object of this invention is to provide in a single self-contained unit a portable combination lamp, smoke detector and power failure detector adapted to operate on batteries as well as on AC line supply.

SUMMARY OF THE INVENTION

This invention features a portable personal warning device comprising a high intensity lamp, a smoke detector and a power failure detector in a single, self-contained, integrated unit. Conventional AC power connection as well as a battery power supply is provided and which can be recharged by the AC power source. An audible alarm is provided which is actuated automatically together with the lamp in the event that either or both the smoke detector or the power failure detector are triggered.

DETAILED DESCRIPTION OF THE PREFERRED EMBODIMENT

Figure 1:
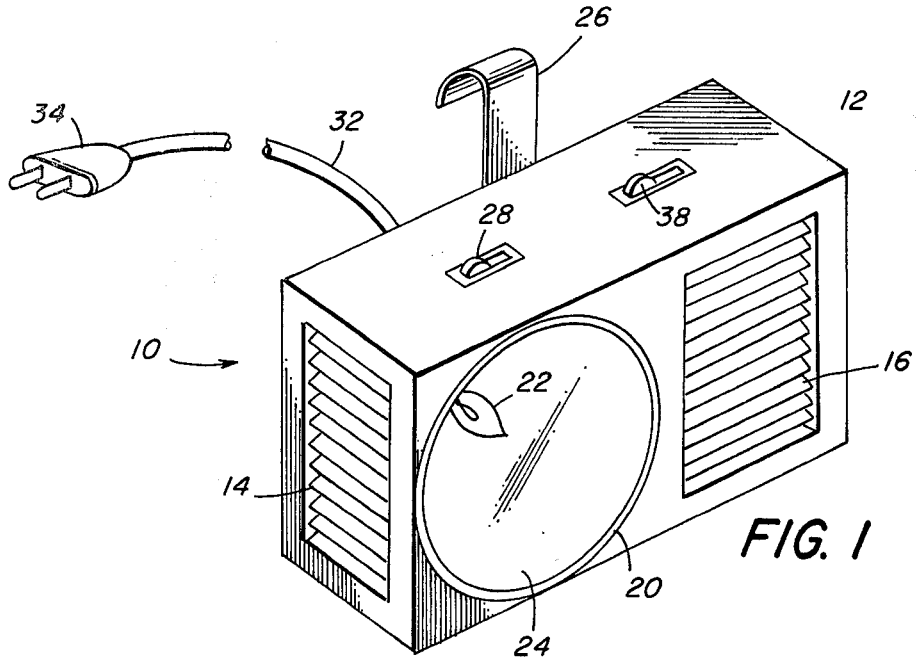
FIG. 1 is a view in perspective of a portable combination lamp, smoke detector and power loss detector made according to the invention.
Figure 2:
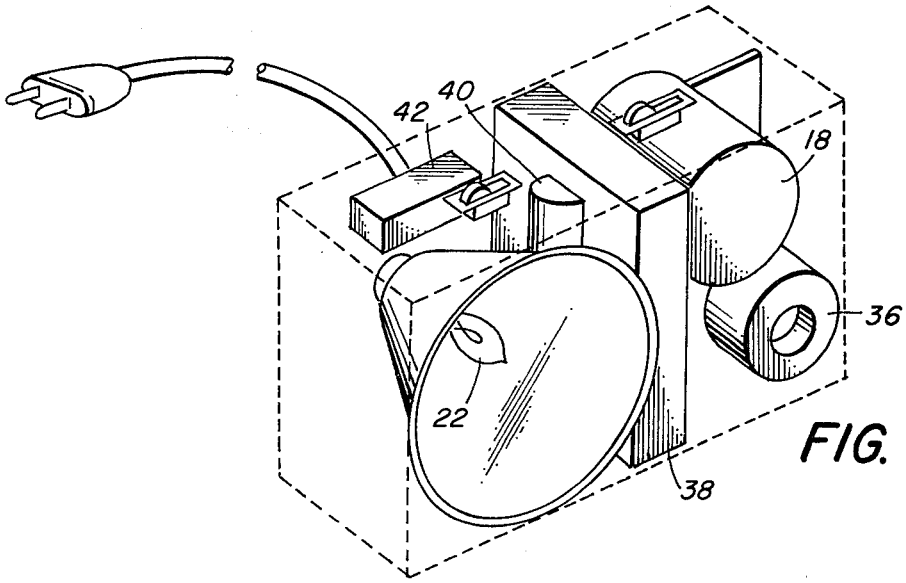
FIG. 2 is a view similar to FIG. 1, but showing the internal components of the unit, and, FIG. 3 is a circuit diagram of the control system for the device.

Referring now to the drawings, the reference character 10 generally indicates a portable combination emergency lamp, smoke detector and power failure detector made according to the invention and generally organized about a housing 12 of a small, compact configuration. In the illustrated embodiment the housing 12 is generally rectangular and in a working embodiment the housing typically is 6" long, 2" deep and 4" high. Obviously these dimensions are only by way of example and can be increased, decreased or otherwise altered to meet various design demands. Also, the use of smaller components within the unit may allow for reducing the size of the unit below the dimensions indicated.

The exterior of the housing 12 is characterized by louvred openings 14 and 16 which allow air to flow through the housing so that an internal smoke detecting sensor 18 can sample the air for the presence of smoke. In the front of the housing is a reflector 20 and bulb 22 forming part of a high beam lamp across the outer face of which is a lens cover 24 which may be a clear glass or plastic, for example, to protect both the bulb and the reflector. At the back of the housing 12 there is provided a clip 26, which preferably is slidably connected to the back wall of the housing to permit its retraction when the unit is packed or stored in a suitcase, for example, and to be slid into an extended position for hanging the unit in a hotel room, dormitory room, or the like. A suitable hanging location might be the headboard of the bed, door frame, bureau handle or the like. In the top of the housing is a pair of manual switches 28 and 30, the switch 30 providing manual control over the electric power failure sensing portion of the unit. A conventional cord 32 terminating in a plug 34 extends from the rear of the unit and allows the unit to be plugged into the standard 110 AC outlet normally available in hotel rooms and the like.

Disposed within the housing is a audible alarm device 36 such as a horn which is energized in the event of an electric power outage or in the event that smoke is detected by the smoke sensing unit 18. Also contained within the housing is a battery 38, preferably a battery pack comprised of six nickel cadmium A batteries. Obviously other batteries of different sizes and types may be used. However, in the preferred embodiment the circuitry is designed to operate at nine volts. Also included within the housing is an electrical outing sensing relay 40 and a battery charging circuit 42. Other circuit elements within the housing by means of which the unit is controlled will be described in detail connection with the circuit diagram of FIG. 3.

Figure 3:
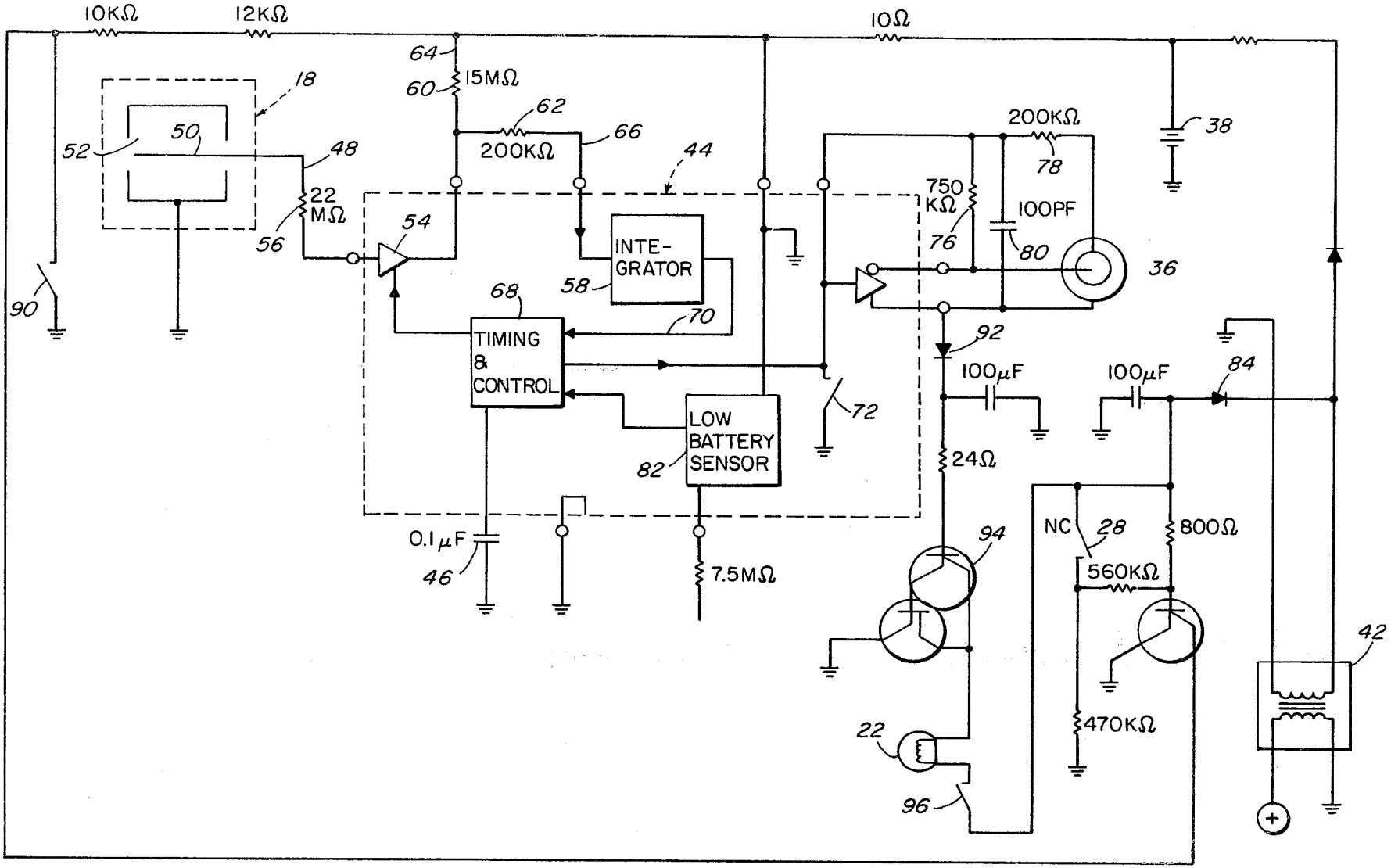

Referring now to FIG. 3 of the drawings, the circuit for the device will be described. The circuit is organized about a pulsed detector system generally indicated at 44 and which, in practice, may be in the form of an integrated circuit microchip such as Motorola type sc42654. The detector system 44 is designed to operate at a pulse rate set by a capacitor 46 and receives an input from the smoke detector 18, which, in the preferred embodiment, is of the ionization chamber type and includes a floating electrode 50 within an ionization chamber 52. The system 44 tests the condition of the ionization chamber 52 at a predetermined rate, typically twice per second, each test lasting about 1/100 of a second. Using a pulsed detecting arrangement the power drain is minimized when the unit is operated in the battery mode and also makes the smoke detector compatable with the remaining portion of the system. The voltage on the floating electrode is fed into an amplifier 54. In normal operation, assuming no smoke particles in the ionization chamber 52, the voltage on the electrode 50 typically is approximately one-half the nine volt supply voltage, or 4.5 volts. Assuming smoke is present the particles will enter the ionization chamber 52 and the voltage on the electrode drops to 3.2 volts or below. The alarm will be actuated causing both the horn 36 to be operated and the lamp 22 to be illuminated. A resistor 56 is provided in the lead 48 to protect the amplifier 54 from static discharge.

The output of the amplifier 54 is coupled to an intergrator 58 by resistors 60 and 62 in leads 64 and 66, respectively. If desired, a variable resistance can be added to adjust the sensitivity of the circuit. When the threshold is reached, the integrator 58 triggers a change in a timing and control circuit 68 to which it is connected by means of a lead 70. The sampling rate, which is a function of the timing and control circuit 68, is increased to forty times per second to hold the alarm on and a switch 72 at the input side of an amplifier 74 is opened. This removes the ground from the input of the amplifier 74 and permits the amplifier 74 and the horn 36 to form an oscillator at the resonant frequency of the horn. This type of operation provides the largest acoustic output for the battery power used. Resistors 76 and 78 and capacitor 80 are provided to ensure that the oscillator will start. When the amplifier 74 is off, both outputs of the amplifier are at zero voltage.

The system 44 also includes a low battery sensor 82 which, when actuated as a result of sensing a low voltage output from the battery 38, will cause the horn 36 to be sounded for approximately 1/100th of a second every 42 seconds. The sensor 82 is designed to actuate the horn when the battery power drops below 7.5 volts.

The circuit comprised of a diode 84 and high gain transistor 86 serves to sense the charging voltage input from a wall mounted 120 volt/15 volt charger which is connected to the unit by means of a cord. When the power is on, a capacitor 88 charges to 15 volts and balances the 8.1 voltage from the switch 28 to keep the transistor 86 off. When the power is lost, 15 volts disappears and the transistor 86 turns on. This acts the same as closing a switch 90 and sounds the alarm and turns on the light 22.

The high powered lamp 22 is actuated by a diode 92 and high grain transistor 94. When the amplifier 74 energizes the horn 36, the diode 92 receives voltage and lights the lamp 22. A normally closed switch 96 may be pushed manually to open the circuit to turn off the lamp to save battery power.

The unit may be conveniently carried about in a suitcase or briefcase by a traveler and placed in a operating condition in a hotel room, for example, by merely plugging the same into the wall outlet of the room. In the event that power in the building should go off while the occupant is asleep or should smoke enter the room, the unit will be actuated causing both the horn as well as the lamp to be operated. These two alarm devices will alert the occupant who may then carry the unit out of the room using the lamp to help in escape. The lamp and the horn will also help to direct rescue personnel such as firemen, or policemen in locating the occupants.

While the invention has been described with particular reference to the illustrated embodiment, numerous modifications thereto will appear to those skilled in the art.

Having thus described the invention, what we claim and desire to obtain by Letters Patent of the United States is:

1. A portable personal warning device adapted to detect smoke or power failure, comprising in combination:

(a) a small portable housing;

(b) a lamp and a reflector mounted to said housing and directed outwardly from one side thereof;

(c) a smoke detector mounted in said housing and in communication with ambient air;

(d) audible alarm means operatively connected to said smoke detector and responsive thereto;

(e) a continuous power interruption detecting means mounted in said housing and connectable to available AC power;

(f) DC power storage means mounted in said housing, including battery recharging means for recharging said DC power storage means;

(g) circuit means connected to said lamp, said smoke detector, said audible alarm means, said power interruption detecting means and said DC power storage means;

(h) control means connected to said circuit means for actuating said lamp and said audible alarm means in the event of an interruption of AC power or smoke detected by said detector; and (i) low and continuous DC power sensing means connected to said DC power storage means and to said circuit means and to said audible alarm means for actuating said audible alarm means in the event of low DC power.

2. A portable hazard warning device according to claim 1 including manually operated switch means connected to said circuit means and to said lamp for manually controlling the operation of said lamp.

3. A portable hazard warning device according to claim 1 wherein said smoke detector is an ionization type detector and includes an ionization chamber and an electrode connected to said circuit means.

4. A portable hazard warning device according to claim 1 wherein said circuit means includes an amplifier and said audible alarm means includes a horn connected to said amplifier and forming an oscillator circuit therewith adapted to operate at the resonant frequency of said horn.

* * * * *